US011604422B2

(12) United States Patent
Araki

(10) Patent No.: US 11,604,422 B2
(45) Date of Patent: Mar. 14, 2023

(54) IMAGE FORMING APPARATUS THAT SELECTS EXPOSURE PATTERN

(71) Applicant: CANON KABUSHIKI KAISHA, Tokyo (JP)

(72) Inventor: Go Araki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/592,247

(22) Filed: Feb. 3, 2022

(65) Prior Publication Data

US 2022/0252998 A1 Aug. 11, 2022

(30) Foreign Application Priority Data

Feb. 8, 2021 (JP) ..... JP2021-018517

(51) Int. Cl.
*G03G 15/043* (2006.01)

(52) U.S. Cl.
CPC ..... *G03G 15/043* (2013.01)

(58) Field of Classification Search
CPC ..... G03G 15/043; G03G 15/556; G03G 2215/0431; G03G 15/04045; G03G 15/04072
See application file for complete search history.

(56) References Cited

U.S. PATENT DOCUMENTS 5,023,632 A * 6/1991 Yamamoto ..... G03G 15/011 399/178
5,754,216 A 5/1998 Higuchi et al.
9,395,644 B2 7/2016 Araki et al.
2015/0227075 A1* 8/2015 Palmer ..... G03F 7/70291 399/51
2015/0355568 A1* 12/2015 Tachibana ..... G03G 15/043 347/118
2017/0220913 A1* 8/2017 Miyadera ..... H04N 1/40068

FOREIGN PATENT DOCUMENTS

| | | | |
|---|---|---|---|
| JP | 08-67027 | A | 3/1996 |
| JP | 2000-343748 | A | 12/2000 |
| JP | 2003-345076 | A | 12/2003 |
| JP | 2016-091009 | A | 5/2016 |
| JP | 2017-105005 | A | 6/2017 |

* cited by examiner

*Primary Examiner* — Jessica L Eley
(74) *Attorney, Agent, or Firm* — Venable LLP

(57) ABSTRACT

An image forming apparatus includes a storage unit configured to store pattern information and a generation unit configured to generate a drive signal for driving an exposure unit. The pattern information indicates a plurality of exposure patterns for a first pixel, the plurality of exposure patterns are selected such that whether exposure patterns that are identical to each other among the plurality of exposure patterns are adjacent to each other, or two exposure patterns that are different from each other among the plurality of exposure patterns are adjacent to each other in the main scanning direction, the non-exposure regions are not consecutively present between the two exposure patterns, and in a case where the plurality of exposure patterns are consecutively used in the main scanning direction, the generation unit randomly selects an exposure pattern to be used.

13 Claims, 11 Drawing Sheets

PATTERN #A

PATTERN #B

PATTERN #A

PATTERN #B

PATTERN #C

PATTERN #D

FIG. 7A

| | | | | | | | | | | | |
|---|---|---|---|---|---|---|---|---|---|---|---|
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 255 | 255 | 255 | 255 | 255 | 255 | 255 | 255 | 255 | 0 | 0 |
| 0 | 255 | 255 | 255 | 255 | 255 | 255 | 255 | 255 | 255 | 0 | 0 |
| 0 | 255 | 255 | 255 | 255 | 255 | 255 | 255 | 255 | 255 | 0 | 0 |
| 0 | 255 | 255 | 255 | 255 | 255 | 255 | 255 | 255 | 255 | 0 | 0 |
| 0 | 255 | 255 | 255 | 255 | 255 | 255 | 255 | 255 | 255 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG. 7B

| | | | | | | | | | | | |
|---|---|---|---|---|---|---|---|---|---|---|---|
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 1 | 1 | 1 | 1 | 1 | 1 | 1 | 1 | 1 | 0 | 0 |
| 0 | 1 | 1 | 1 | 1 | 1 | 1 | 1 | 1 | 1 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |
| 0 | 0 | 0 | 0 | 0 | 0 | 0 | 0 | 0 | 0 | 0 | 0 |

FIG. 8A

| | | | | | | | | | | | |
|---|---|---|---|---|---|---|---|---|---|---|---|
| 0 | 255 | 255 | 255 | 255 | 255 | 255 | 255 | 255 | 255 | 0 | 0 |

FIG. 8B

| | | | | | | | | | | | |
|---|---|---|---|---|---|---|---|---|---|---|---|
| 0 | 128 | 128 | 128 | 128 | 128 | 128 | 128 | 128 | 128 | 0 | 0 |

FIG. 8C

| | | | | | | | | | | | |
|---|---|---|---|---|---|---|---|---|---|---|---|
| 0 | 64 | 64 | 64 | 64 | 64 | 64 | 64 | 64 | 64 | 0 | 0 |

IMAGE FORMING APPARATUS THAT SELECTS EXPOSURE PATTERN

BACKGROUND OF THE INVENTION

Field of the Invention

The present invention relates to an image forming apparatus such as a copying machine, a laser beam printer, and a facsimile machine, and more particularly relates to a technique of suppressing unnecessary radiation noise emitted from an image forming apparatus.

Description of the Related Art

An image forming apparatus is required to maintain quality of a formed image. On the other hand, an image forming apparatus using electrophotography may generate a phenomenon called sweeping or edge effect in which toner excessively adheres to an edge portion of an electrostatic latent image formed on a photoconductor. Sweeping refers to a phenomenon in which toner excessively adheres to an edge portion, in an edge of an electrostatic latent image, located on a rear side with respect to a rotational direction of a photoconductor. Edge effect refers to a phenomenon in which toner excessively adheres to an edge portion located on the periphery of an electrostatic latent image. Japanese Patent Laid-Open No. 2003-345076 and Japanese Patent Laid-Open No. 2000-343748 disclose a configuration in which sweeping and edge effect are suppressed by adjusting an exposure amount with use of pulse width modulation.

In the configuration according to Japanese Patent Laid-Open No. 2003-345076 and Japanese Patent Laid-Open No. 2000-343748, excessive adhesion of toner to an edge portion of an electrostatic latent image can be suppressed, but unnecessary radiation noise (electromagnetic waves radiated) occurs due to pulse width modulation.

SUMMARY OF THE INVENTION

According to an aspect of the present disclosure, an image forming apparatus includes: a photoconductor; an exposure unit configured to form an electrostatic latent image on the photoconductor by scanning the photoconductor with light in a main scanning direction and exposing the photoconductor to the light; a developing unit configured to develop the electrostatic latent image with developer and form an image on the photoconductor; a storage unit configured to store pattern information indicating an exposure pattern that is a pattern including an exposure region and a non-exposure region of a pixel along the main scanning direction; and a generation unit configured to generate a drive signal for driving the exposure unit, based on first image data and by using the exposure pattern indicated by the pattern information, wherein the pattern information indicates a plurality of exposure patterns for a first pixel, the plurality of exposure patterns of the first pixel are selected such that whether exposure patterns that are identical to each other among the plurality of exposure patterns of the first pixel are adjacent to each other in the main scanning direction, or two exposure patterns that are different from each other among the plurality of exposure patterns of the first pixel are adjacent to each other in the main scanning direction, the non-exposure regions are not consecutively present across a boundary between the two exposure patterns adjacent to each other, and in a case where the plurality of exposure patterns of the first pixel are consecutively used in the main scanning direction, the generation unit randomly selects an exposure pattern to be used from the plurality of exposure patterns, or selects, in a predetermined order, an exposure pattern to be used from the plurality of exposure patterns.

Further features of the present invention will become apparent from the following description of exemplary embodiments with reference to the attached drawings.

BRIEF DESCRIPTION OF THE DRAWINGS

FIG. 7A is a view illustrating an example of image data.

FIG. 7B is a view illustrating an example of a correction target pixel in the image data of FIG. 7A.

FIGS. 8A to 8C are explanatory views of processing performed by an exposure amount adjustment unit.

DESCRIPTION OF THE EMBODIMENTS

Figure 1:
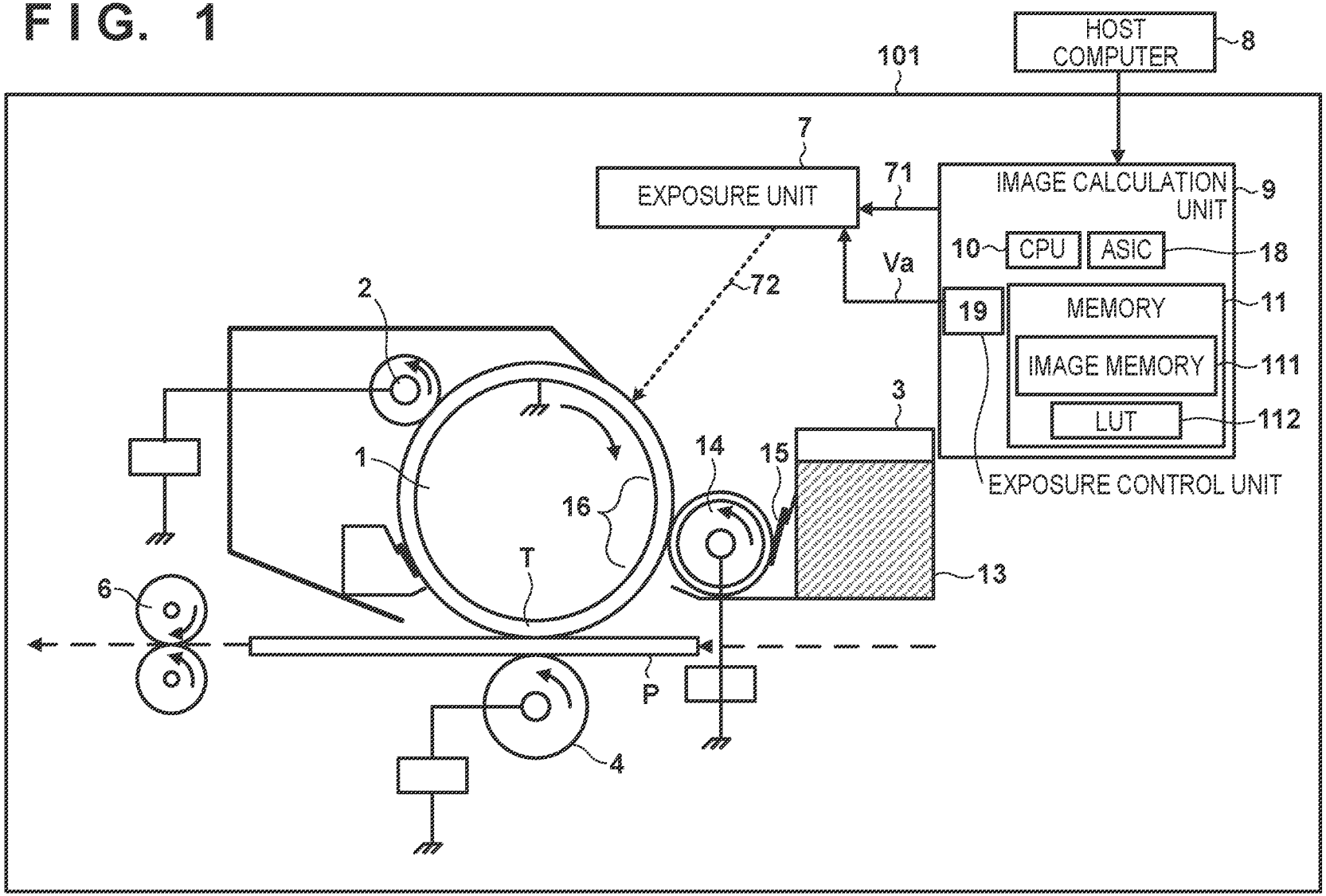
FIG. 1 is a configuration diagram of an image forming apparatus according to an embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment

FIG. 1 is a configuration diagram of an image forming apparatus 101 according to the present embodiment. A photoconductor 1 that is an image carrier is rotationally driven in a direction indicated by an arrow in the figure, during image formation. A charging unit 2 charges a surface of the photoconductor 1 to a uniform potential. An exposure unit 7 scans the charged surface of the photoconductor 1 with light 72 based on image data and exposes the charged surface of the photoconductor 1 to the light 72 based on image data, and the exposure unit 7 forms an electrostatic latent image on the photoconductor 1. A direction in which the exposure unit 7 scans the photoconductor 1 with the light 72 is referred to as a main scanning direction. Note that the exposure unit 7 is driven by a drive signal 71 output by an image calculation unit 9. An exposure control unit 19 of the image calculation unit 9 adjusts, with use of voltage Va, exposure intensity of the exposure unit 7 to a target value.

A developing unit 3 is provided with a container 13 storing toner that is developer, and a developing roller 14. The toner may be nonmagnetic mono-component toner, or may be two-component toner, or may be magnetic toner. A regulating blade 15 is arranged to regulate a layer thickness of the toner supplied to the developing roller 14 to a predetermined value. The regulating blade 15 can also be configured to give the toner charge. The developing roller 14 conveys the toner to a developing region 16. Note that the developing region 16 refers to a region where the developing roller 14 and the photoconductor 1 come close to each other or come into contact with each other, and where adhesion of the toner to the electrostatic latent image is carried out. The developing unit 3 causes the toner to adhere to the electrostatic latent image formed on the photoconductor 1, and a toner image is visualized. A transfer unit 4 transfers the toner image formed on the photoconductor 1 to a printing medium P. A fixing unit 6 applies heat and pressure to the printing medium P on which the toner image is transferred, and fixes the toner image on the printing medium P.

A CPU 10 of the image calculation unit 9 is a control unit that performs overall control of all the image forming apparatus 101. Note that in addition to the configuration in which the CPU 10 executes all control explained below, there can be a configuration in which an ASIC 18 executes a portion of the control. In addition, there can also be a configuration in which the ASIC 18 executes all the control explained below. A memory 11 is a storage unit, and the memory 11 stores image data in an image memory 111, and also stores an LUT 112. The LUT 112 is a lookup table, and indicates various kinds of information pertaining to image processing. The image calculation unit 9 receives image data transmitted from a host computer 8, and the image calculation unit 9 suppresses influence of edge effect and sweeping, based on information held by the LUT 112, and corrects the image data such that a toner consumption amount is reduced.

Figure 2A:
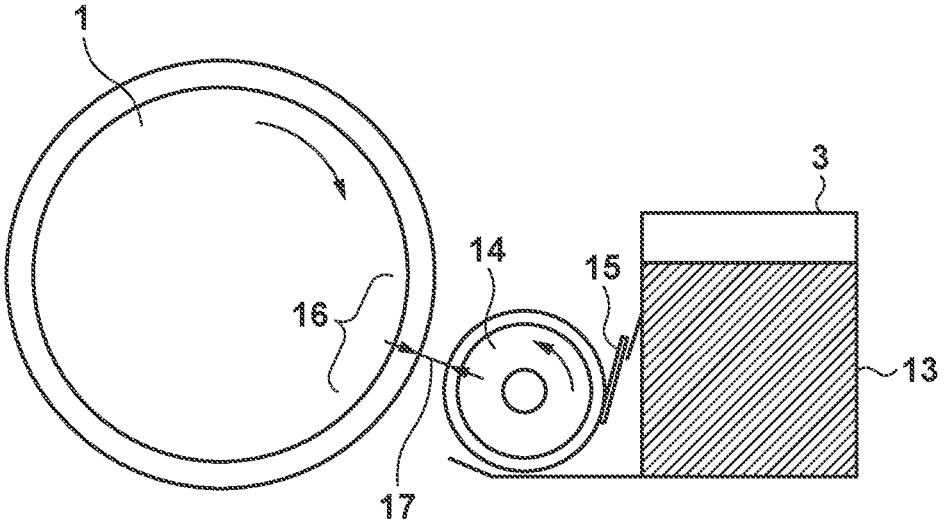
FIG. 2A is an explanatory view of a jumping development system.
Figure 2B:
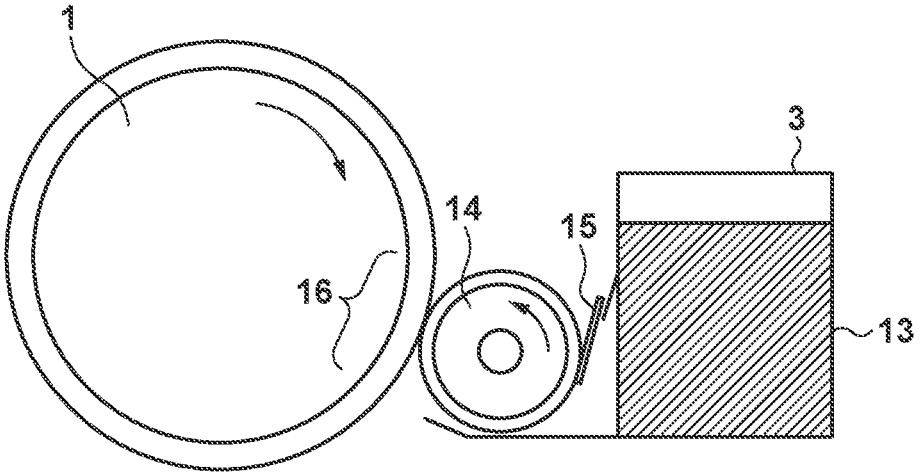
FIG. 2B is an explanatory view of a contact development system.

Next, development systems will be explained with reference to FIGS. 2A and 2B. FIG. 2A illustrates the developing unit 3 that uses a jumping development system. In the jumping development system, the developing roller 14 and the photoconductor 1 do not come into contact with each other, and a gap 17 having a predetermined distance is arranged. Then, alternating-current bias formed by superimposing direct-current bias is used as developing bias to be output by the developing roller 14. FIG. 2B illustrates a configuration of the developing unit 3 that uses a contact development system. In the contact development system, the developing roller 14 and the photoconductor 1 come into contact with each other. Then, direct-current bias is used as developing bias to be output by the developing roller 14.

Figure 3A:
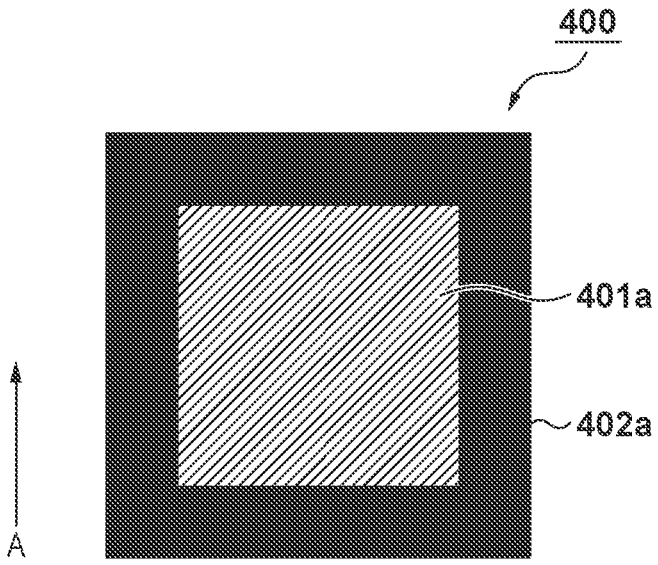
FIG. 3A illustrates an image that generates edge effect.

Next, a principle of occurrence of each of edge effect and sweeping in which an amount of toner adhering to an electrostatic latent image increases in an edge portion of the electrostatic latent image will be explained. Edge effect refers to a phenomenon in which an electric field concentrates in a boundary between an electrostatic latent image formed on the photoconductor 1, that is, an exposure region of the photoconductor 1, and a non-exposure region other than the exposure region of the photoconductor 1, and thus, toner excessively adheres to each edge of the electrostatic latent image. FIG. 3A illustrates a toner image 400 that generates edge effect. An arrow A of FIG. 3A indicates a conveyance direction of the toner image, that is, a rotational direction of the photoconductor 1. Note that it is assumed that all pixels in original image data of the toner image 400 have the same pixel value, that is, the toner image 400 is an image having uniform density. In a case where edge effect is generated, toner concentrates in and adheres to all of an edge region 402*a* of the toner image 400. As a result, density in the edge region 402*a* exceeds density in a non-edge region 401*a*. Note that edge effect mainly occurs in the jumping development system in which a gap is arranged between the photoconductor 1 and the developing roller 14.

Figure 3B:
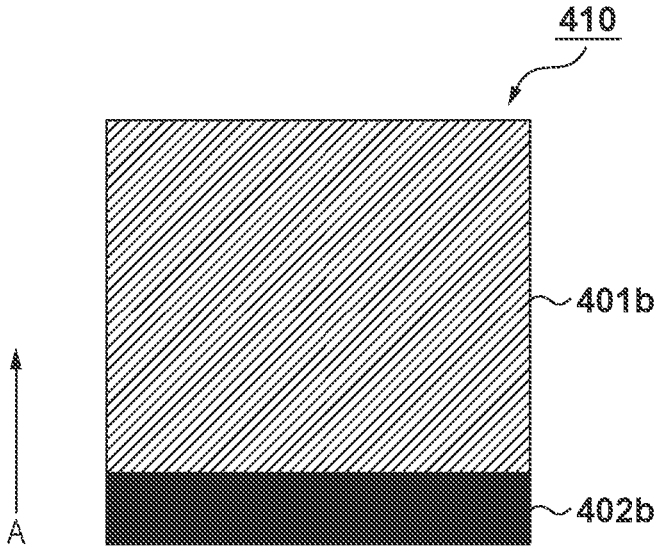
FIG. 3B illustrates an image that generates sweeping.

On the other hand, sweeping refers to a phenomenon in which toner concentrates in a rear end of an electrostatic latent image in the rotational direction of the photoconductor 1. FIG. 3B illustrates a toner image 410 that generates sweeping. An arrow A of FIG. 3B indicates a conveyance direction of the toner image, that is, the rotational direction of the photoconductor 1. Note that it is assumed that all pixels in original image data of the toner image 410 have the same pixel value, that is, the toner image 410 is an image having uniform density. In a case where sweeping is generated, a toner amount in a rear end region 402*b* of the toner image 410 increases. This is because in a case where circumferential speed of the developing roller 14 is greater than circumferential speed of the photoconductor 1, toner held in a portion of the developing roller 14 entering the developing region 16 concentrates in and adheres to the rear end region 402*b* located in the developing region 16 when the portion passes the rear end region 402*b*. As a result, density in the rear end region 402*b* exceeds density in a region 401*b* other than the rear end region 402*b*.

Figure 4:
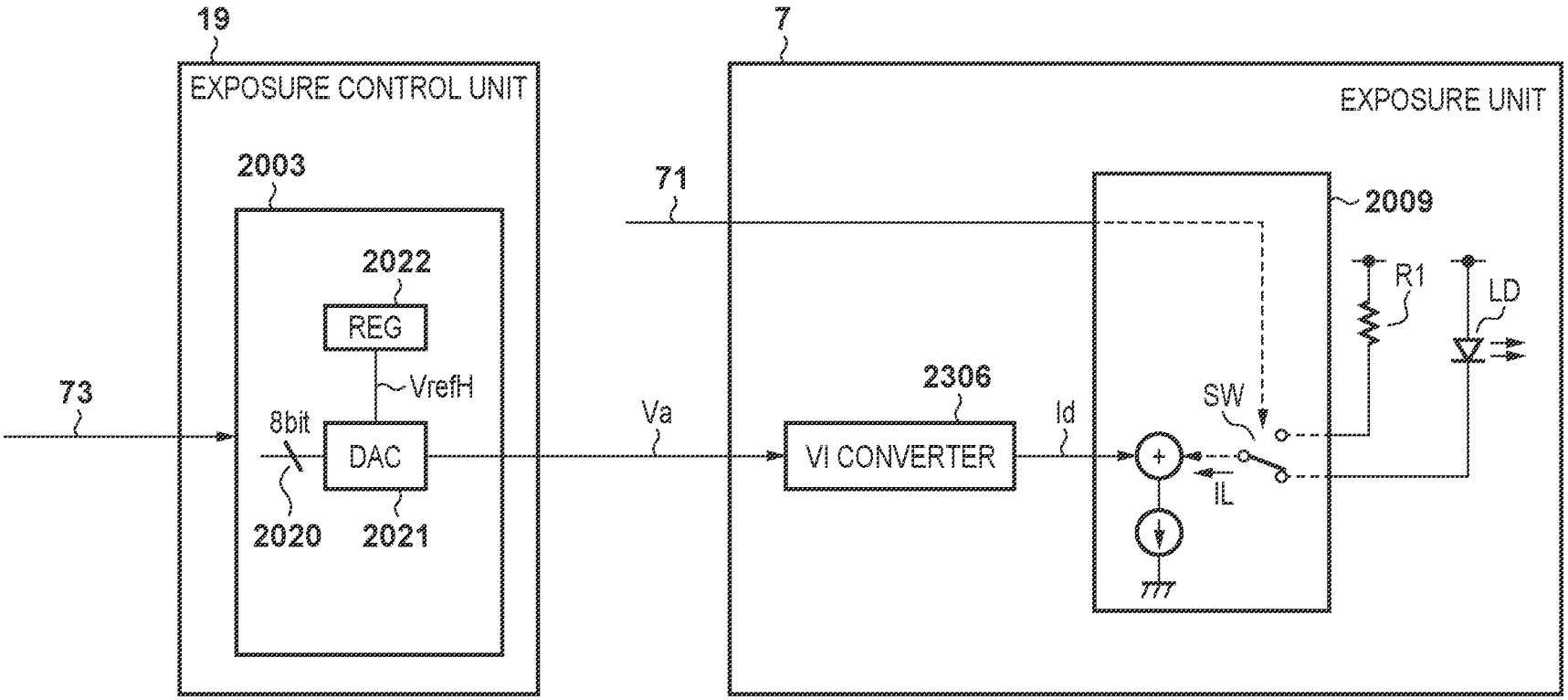
FIG. 4 illustrates a configuration of controlling an exposure amount according to an embodiment.

FIG. 4 illustrates a configuration of controlling the exposure unit 7. The exposure control unit 19 is provided with an IC 2003 including a DA converter (DAC) 2021 of 8 bits and a regulator (REG) 2022. The IC 2003 adjusts voltage VrefH output by the regulator 2022, based on an intensity adjustment signal 73 set by the CPU 10. The voltage VrefH becomes reference voltage of the DA converter 2021. The IC 2003 sets input data 2020 of the DA converter 2021, and thus, the DA converter 2021 outputs the voltage Va to the exposure unit 7. A VI conversion circuit 2306 of the exposure unit 7 converts the voltage Va into current having a current value Id, and outputs the current to a driver IC 2009. The driver IC 2009 controls, with use of the current value Id, current IL flowing in a laser diode (LD) of the exposure unit 7, and thus, controls light emission intensity of the LD of the exposure unit 7, that is, the exposure intensity of the exposure unit 7. Therefore, the exposure control unit 19 can control, with use of the voltage Va, the exposure intensity of the exposure unit 7. In addition, the driver IC 2009 performs switching of a switch (SW) of the driver IC 2009, in accordance with the drive signal 71 output by the image calculation unit 9. The SW performs on/off control of emission of the LD by switching between a flow of the current IL in the LD of the exposure unit 7 and a flow of the current IL in a dummy resistor R1. Note that it is assumed in the present embodiment that when the drive signal 71 is at a high level, the LD emits light, but there may also be a configuration in which when the drive signal 71 is at a low level, the LD emits light.

Figure 5A:
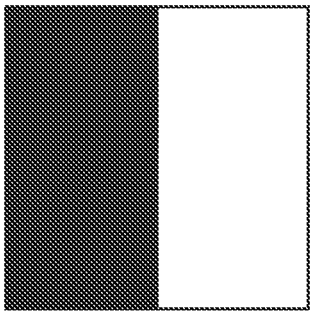
FIGS. 5A to 5D are explanatory views of exposure patterns of one pixel.
Figure 5B:
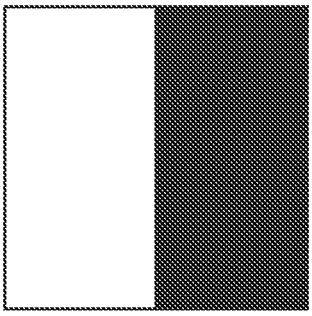
Figure 5C:
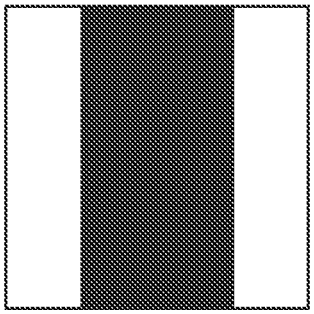
Figure 5D:
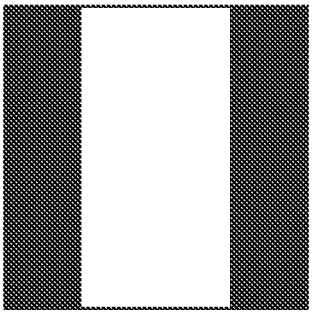

Next, a plurality of exposure patterns of a pixel according to the present embodiment will be explained. In the present embodiment, an exposure amount is adjusted by adjusting, with use of Pulse Width Modulation (PWM), exposure time (exposure interval) in the main scanning direction in a pixel. FIGS. 5A to 5D each illustrate an exposure pattern for realizing an exposure amount of 50%. Note that in FIGS. 5A to 5D and figures illustrating pixel columns explained below, a direction from left to right in the figures is the main scanning direction. In FIG. 5A, a pixel is divided into two regions, and a first region is set as an exposure region and a second region is set as a non-exposure region. Note that it is assumed in the following explanation that numbers such as the first, the second, and the like become larger along the main scanning direction. That is, the numbers become sequentially larger from left to right of the figures. In FIG. 5B, a pixel is divided into two regions, and a first region is set as a non-exposure region and a second region is set as an exposure region. Further, in FIG. 5C, a pixel is divided into three regions, and a first region and a third region are set as non-exposure regions and a second region is set as an exposure region. Further, in FIG. 5D, a pixel is divided into three regions, and a first region and a third region are set as exposure regions and a second region is set as a non-exposure region.

Since FIGS. 5A to 5D each illustrate the case where an exposure amount is 50%, the area of the exposure region and the area of the non-exposure region in a pixel are identical to each other in each of FIGS. 5A to 5D. Note that in the present example, a pixel is divided in the main scanning direction into three regions at most, but a pixel can also be divided into four or more regions. In addition, in FIGS. 5C and 5D, lengths in the main scanning direction of the first region and the third region are identical to each other, but the lengths may be different from each other. In the following explanation, the exposure patterns of a pixel illustrated in FIGS. 5A, 5B, 5C and 5D are referred to as patterns #A, #B, #C, and #D, respectively.

Figure 6:
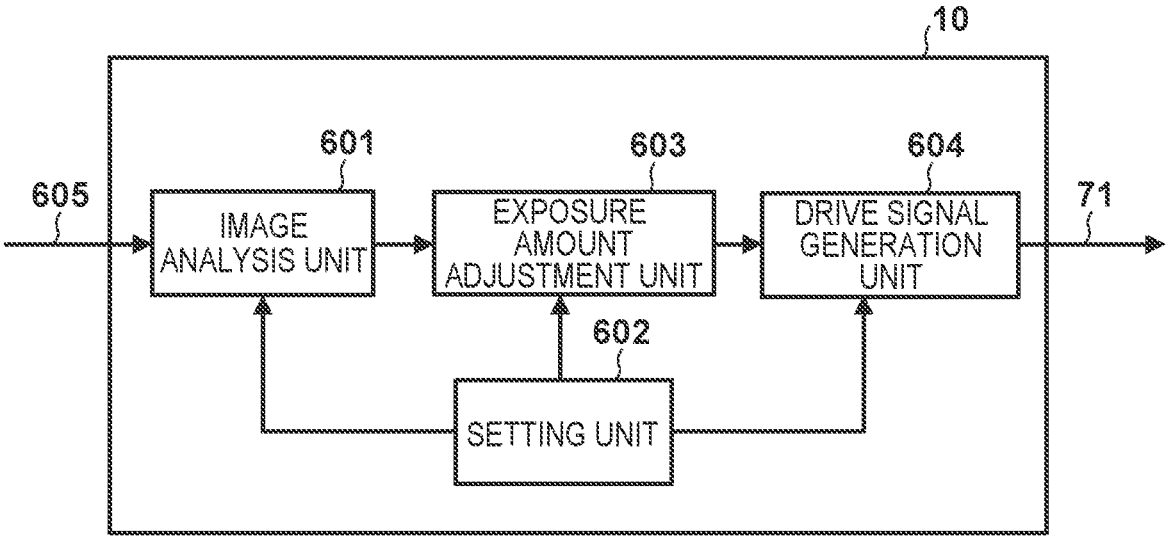
FIG. 6 is a functional block diagram of a CPU for generating a drive signal according to an embodiment.

FIG. 6 is a functional block diagram of the CPU 10 for suppressing edge effect or sweeping, and for suppressing unnecessary radiation noise. Note that as explained above, the functional blocks illustrated in FIG. 6 can be realized by both the ASIC 18 and the CPU 10, or can be realized by only the ASIC 18. The LUT 112 (FIG. 1) holds correction pixel identification information, exposure amount correction information, and pattern information. A setting unit 602 performs notification and setting of the correction pixel identification information, the exposure amount correction information, and the pattern information held by the LUT 112 on an image analysis unit 601, an exposure amount adjustment unit 603, and a drive signal generation unit 604. Image data 605 transmitted from the host computer 8 and stored in the memory 11 is input to the image analysis unit 601. The image analysis unit 601 identifies, based on the correction pixel identification information, a correction target pixel that may generate edge effect or sweeping from among pixels of an image formed from the image data 605, and the image analysis unit 601 notifies the exposure amount adjustment unit 603 of the identified correction target pixel together with the image data 605. Note that here, the "image" refers to a region to which toner consecutively adheres. That is, rather than one image being formed on one printing medium P, one or more images can be formed on one printing medium P, in accordance with an adhesion state of toner. For example, the correction pixel identification information can indicate the range of pixels that may generate edge effect or sweeping, as the number of the pixels located from a pixel in an edge of an image. For example, when the correction pixel identification information is "5", it is determined that five pixels located from an edge of a region (image) to which toner consecutively adheres are correction target pixels. Note that any parameter that can identify a pixel that may generate edge effect or sweeping can be used as the correction pixel identification information.

The exposure amount adjustment unit 603 corrects, based on the exposure amount correction information, a pixel value of the correction target pixel indicated by the image data 605, and outputs the image data 605 obtained after the correction to the drive signal generation unit 604. The exposure amount correction information indicates a correction amount of an exposure amount of a correction target pixel. As an example, the exposure amount correction information may indicate a reduction rate of an exposure amount. The drive signal generation unit 604 generates the drive signal 71, based on the image data 605 obtained after the correction performed by the exposure amount adjustment unit 603, and based on the pattern information. The pattern information is information indicating, for pixels each having a pixel value other than a maximum value and a minimum value, a plurality of exposure patterns of a pixel. For example, in a case where a maximum pixel value is 255, the pattern information for an exposure amount of 50%, that is, for a pixel value of 128, can indicate two or more exposure patterns in FIGS. 5A to 5D. Note that a pixel value other than a maximum value and a minimum value is used because in the case of a maximum value, all regions of a pixel are exposed to light, and in the case of a minimum value, all regions of a pixel are not exposed to light. This is because only one exposure pattern exists for pixels having a maximum value and a minimum value.

FIG. 7A illustrates an example of the image data 605. Note that in FIG. 7A, a pixel value of a pixel of an image formed from the image data 605 is indicated at a pixel position of the pixel. In addition, in the following explanation, a pixel value of maximum density is set to 255. Therefore, when a pixel value is 255, an exposure amount is 100%, and all regions of a pixel are exposed to light. In the image data 605 of FIG. 7A, toner consecutively adheres to 45 pixels located in a second column to a tenth column from left in a third row to a seventh row from top of the figure. That is, the 45 pixels form one image. For example, it is assumed that suppression of sweeping is performed, and the correction pixel identification information indicates "2." In addition, it is assumed that the rotational direction of the photoconductor 1 is a direction from a lower side to an upper side of FIG. 7. In this case, the image analysis unit 601 determines that pixels located in pixel columns in two rows from an edge located on a lower side toward an upper side among the 45 pixels constituting the image are correction target pixels. FIG. 7B illustrates the correction target pixels of this case. Note that in FIG. 7B, the correction target pixels are each denoted by "1," and pixels that are not the correction target pixels are each denoted by "0."

The exposure amount adjustment unit 603 corrects pixel values of the correction target pixels, based on the exposure amount correction information. FIG. 8A illustrates pixel values of the pixels located in a pixel column in a sixth row from top of FIG. 7A and including the correction target pixels. FIG. 8B illustrates pixels values obtained after the correction performed by the exposure amount adjustment unit 603 in a case where the exposure amount correction information of the correction target pixels of FIG. 8A indicates an exposure amount of 50%. In addition, FIG. 8C illustrates pixel values obtained after the correction performed by the exposure amount adjustment unit 603 in a case where the exposure amount correction information of the correction target pixels of FIG. 8A indicates an exposure amount of 25%. In this manner, the exposure amount adjustment unit 603 corrects the image data 605, based on the exposure amount correction information. Note that a correction amount of an exposure amount indicated by the exposure amount correction information may be different in accordance with a distance from an edge of a pixel. Further, a correction amount of an exposure amount indicated by the exposure amount correction information may be different in accordance with a pixel value. Further, a correction amount of an exposure amount indicated by the exposure amount correction information may be different in accordance with a distance from an edge of a pixel and a pixel value of the pixel.

Figure 9A:
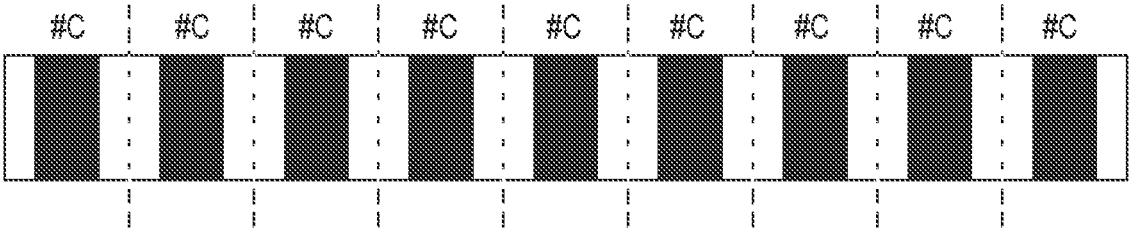
FIGS. 9A to 9E are views illustrating examples of exposure patterns of pixels having the same pixel value and being consecutively present along a main scanning direction.
Figure 9B:
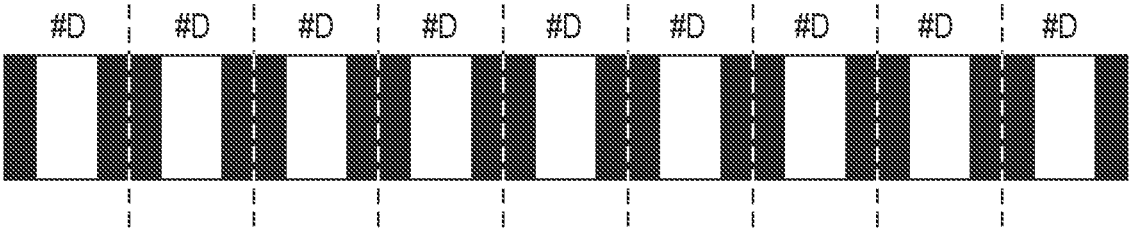
Figure 9C:
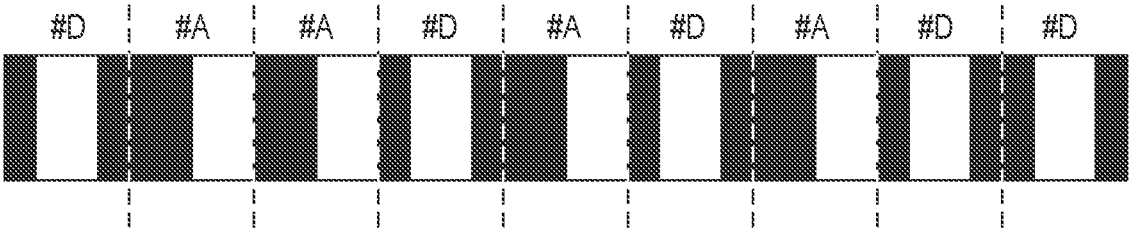
Figure 9D:
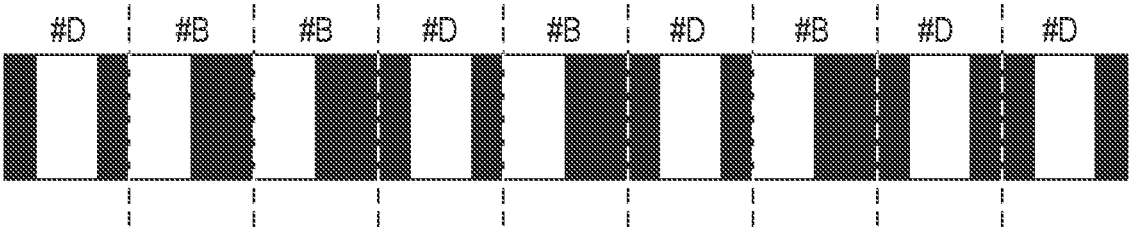

The drive signal generation unit 604 generates the drive signal 71, based on the image data 605 obtained after the correction performed by the exposure amount adjustment unit 603, and based on the pattern information. FIGS. 9A to 9E are explanatory views of the drive signal 71 for a portion in which the nine pixels each having a pixel value of "128" of FIG. 8B are consecutively present. FIG. 9A illustrates the case where only the pattern #C is used for the nine pixels consecutively present. In addition, FIG. 9B illustrates the case where only the pattern #D is used for the nine pixels consecutively present. As illustrated in FIGS. 9A and 9B, when the same exposure pattern is continuously used in a case where pixels having the same pixel value are consecutively present in the main scanning direction, the exposure pattern becomes a pattern in which an exposure region and a non-exposure region are regularly repeated. That is, the drive signal 71 that is of PWM becomes a signal in which a high level (corresponding to an exposure region) and a low level (corresponding to a non-exposure region) are regularly repeated, and a frequency component corresponding to the regular repetition becomes stronger, and unnecessary radiation noise is likely to be generated. Therefore, in the present embodiment, as illustrated in FIG. 9C or FIG. 9D, the drive signal 71 is prevented from becoming a signal including the regular repetition. In FIG. 9C, the pattern #A and the pattern #D are used. Note that whether the pattern #A or the pattern #D is used for certain pixel can be selected and determined randomly, for example. Similarly, in FIG. 9D, the pattern #B and the pattern #D are randomly used.

Note that as illustrated in FIG. 9C, in a case where the pattern #A and the pattern #D are used, whether the patterns #A are consecutively present, or the patterns #D are consecutively present, or the pattern #D is present after the pattern #A, or the pattern #A is present after the pattern #D, non-exposure regions of two consecutive pixels are not consecutively present. In addition, lengths of non-exposure regions of the pattern #A and pattern #D are identical to each other. Therefore, even when an exposure pattern to be used is randomly selected from the pattern #A and the pattern #D, non-exposure regions of two pixels adjacent to each other in the main scanning direction are not consecutively present, and therefore, lengths in the main scanning direction of the non-exposure regions become constant. The lengths in the main scanning direction of the non-exposure regions are constant in a portion in which pixels having the same pixel value are consecutively present, and thus, image quality can be maintained. As illustrated in FIG. 9D, the same applies to the case where the pattern #B and the pattern #D are used.

Thus, in the present embodiment, two exposure patterns indicated by the pattern information are selected such that even when the two exposure patterns are consecutively used in the main scanning direction, a non-exposure region of a pixel to be exposed to light earlier and a non-exposure region of a pixel to be exposed to light later are not consecutively present. FIG. 9C illustrates an example of the case where the pattern information indicates the pattern #A and the pattern #D, and FIG. 9D illustrates an example of the case where the pattern information indicates the pattern #B and the pattern #D.

Note that in FIGS. 9C and 9D, two exposure patterns are selected for certain pixel, but there can also be a configuration in which three or more exposure patterns are selected for certain pixel. That is, a plurality of (two or more) exposure patterns indicated by the pattern information for each pixel can be selected. Note that a plurality of exposure patterns of certain pixel are selected such that regardless of order in which respective exposure patterns of the plurality of exposure patterns are consecutively used in the main scanning direction, non-exposure regions are not consecutively present across a boundary between the exposure patterns. In addition, lengths in the main scanning direction of non-exposure regions of a plurality of exposure patterns of certain pixel are set to be constant. Note that the pattern information is arranged for each of pixel values of pixels other than pixels having a maximum value and a minimum value of a pixel value, in the present example, 255 and 0. Further, there can also be a configuration in which a plurality of exposure patterns for a plurality of pixels being consecutively present in the main scanning direction and having the same pixel value are added to the pattern information. In this case, in accordance with the number of pixels being consecutively present and having the same pixel value, an exposure pattern to be applied is randomly selected from a plurality of exposure patterns corresponding to the number of the pixels being consecutively present, and the drive signal 71 is generated. In any case, unnecessary radiation noise can be reduced by using the drive signal 71 in which a high level and a low level are not regularly repeated.

Figure 10:
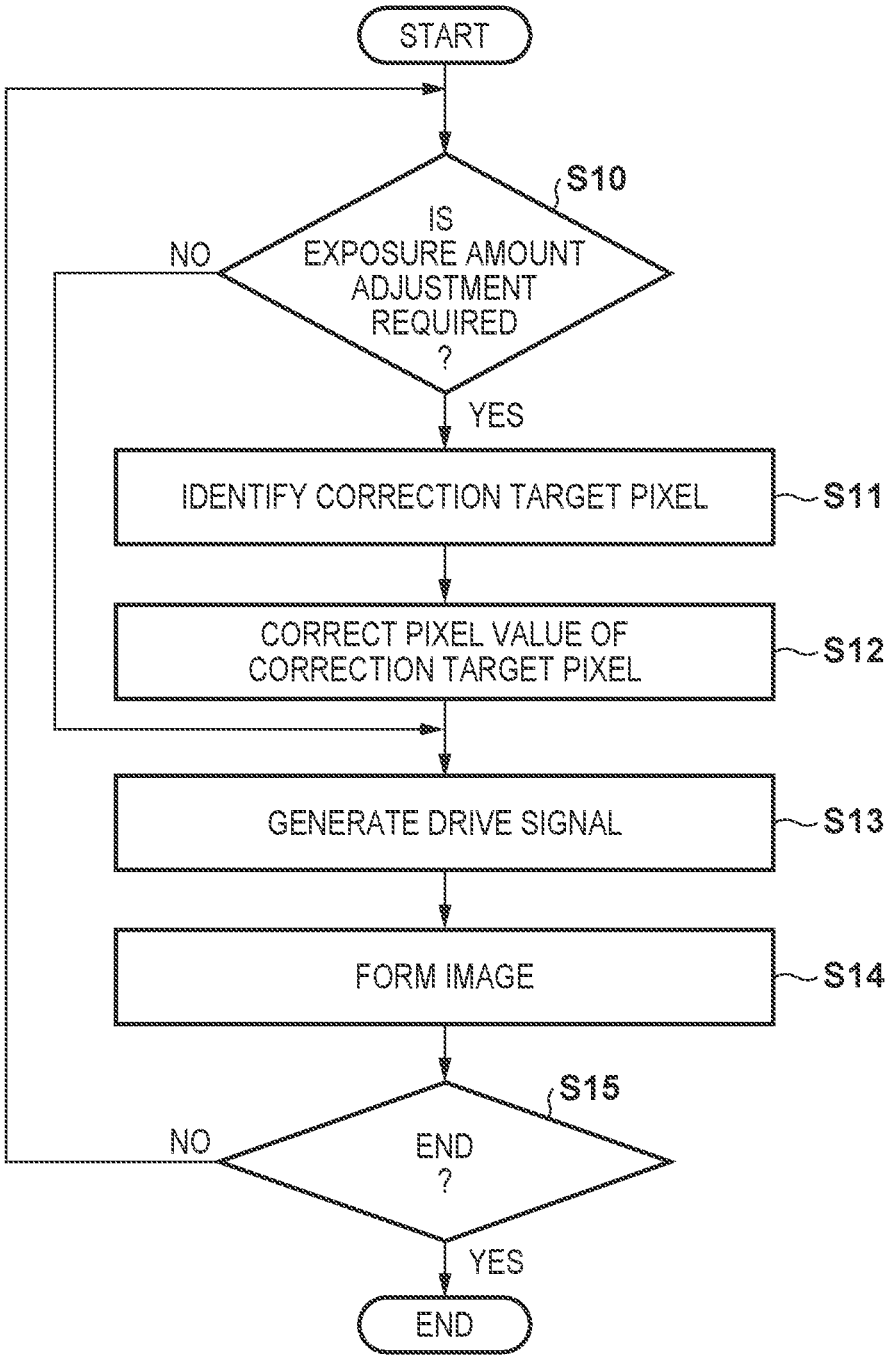
FIG. 10 is a flowchart of image forming processing according to an embodiment.

FIG. 10 is a flowchart of image forming processing according to the present embodiment. When the CPU 10 receives the image data 605 from the host computer 8, the CPU 10 determines at S10 whether or not adjustment of an exposure amount is required in consideration of an apparatus state and the like. In a case where no adjustment of an exposure amount is required, the CPU 10 generates the drive signal 71, based on the image data 605 at S13, and forms an image, based on the drive signal 71 at S14. On the other hand, in a case where adjustment of an exposure amount is required, the CPU 10 determines a correction target pixel, based on the correction pixel identification information at S11. Subsequently, at S12, the CPU 10 corrects an exposure amount, more specifically, corrects a pixel value of the correction target pixel, based on the exposure amount correction information. Subsequently, the CPU 10 generates, at S13, the drive signal 71, based on the image data 605 obtained after the correction, and forms an image at S14. Next, the CPU 10 determines at S15 whether or not image formation has ended, and repeats the processing from S10 until image formation ends.

As described above, in the present embodiment, in the image forming apparatus, the pattern information indicating a plurality of exposure patterns is stored in advance for pixels each having a pixel value other than a maximum value and a minimum value. An exposure pattern of a pixel refers to a pattern including an exposure region and a non-exposure region along the main scanning direction. Note that a plurality of exposure patterns for an identical pixel are different from one another, but the sum of the area of exposure regions is the same value in accordance with a pixel value of the pixel. In addition, the lengths in the main scanning direction of non-exposure regions of a plurality of exposure patterns of a pixel having the same pixel value are constant. Here, in the present embodiment, a plurality of exposure patterns for certain pixel are selected such that whether two identical exposure patterns are aligned in the main scanning direction, or any two different exposure patterns are aligned in the main scanning direction, non-exposure regions are not consecutively present across a boundary between the exposure patterns. Then, in a case where exposure patterns of an identical pixel are consecutively used in the main scanning direction, an exposure pattern to be used is randomly selected from the plurality of exposure patterns of the pixel. According to this configuration, unnecessary radiation noise can be suppressed. In addition, a plurality of exposure patterns of certain pixel are selected such that non-exposure regions are not consecutively present across a boundary between the exposure patterns, and thus, the lengths in the main scanning direction of non-exposure regions do not vary, and image quality can be maintained.

Note that for example, when an exposure pattern to be applied is randomly selected from a plurality of exposure patterns in a case where pixels having an identical pixel value are consecutively present, the random selection can target entire image data obtained after the correction performed by the exposure amount adjustment unit 603. In addition, there can also be a configuration in which when an exposure pattern to be applied is randomly selected from a plurality of exposure patterns in a case where pixels having an identical pixel value are consecutively present, the random selection is limited to a correction target pixel. In any case, unnecessary radiation noise can be suppressed by an inexpensive configuration, and edge effect or sweeping can also be reduced, and accordingly, image quality can be increased and unnecessary toner consumption can be suppressed.

Note that in the present embodiment, in a case where exposure patterns of an identical pixel are consecutively used in the main scanning direction, an exposure pattern to be used is randomly selected from a plurality of exposure patterns of the pixel. However, there can also be a configuration in which in a case where exposure patterns of an identical pixel are consecutively used in the main scanning direction, selection order (predetermined order) of the exposure patterns is determined in advance, and an exposure pattern to be used is selected in the selection order. The selection order can be determined to suppress unnecessary radiation noise, and can be, for example, information held by the LUT 112.

Second Embodiment

Next, a second embodiment will be explained mainly on differences from the first embodiment. In the first embodiment, a plurality of exposure patterns indicated by the pattern information are set such that regardless of how the exposure patterns are consecutively used in the main scanning direction, non-exposure regions are not consecutively present. In the present embodiment, no such restriction is arranged. That is, in the present embodiment, a plurality of exposure patterns of certain pixel indicated by pattern information are allowed to include at least a set of (two) exposure patterns in which, when the set of exposure patterns are consecutively used in a main scanning direction, non-exposure regions are consecutively present. In the following, the present embodiment will be explained, assuming as an example that the pattern information indicates the three exposure patterns of the patterns #A, #B, and #D (FIGS. 5A, 5B and 5D) for a pixel subjected to an exposure amount of 50%.

Figure 11A:
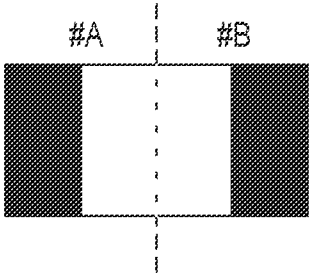
FIGS. 11A to 11I are views each illustrating a combination of exposure patterns of two pixels being adjacent to each other and having the same pixel value, according to an embodiment.
Figure 11B:
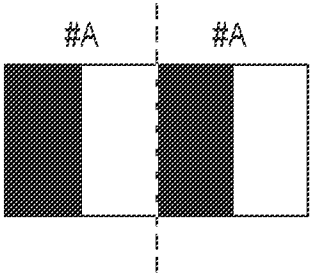
Figure 11C:
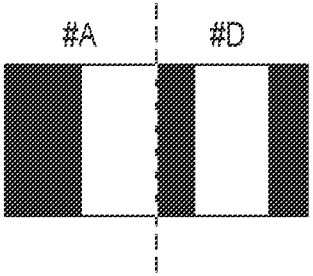
Figure 11D:
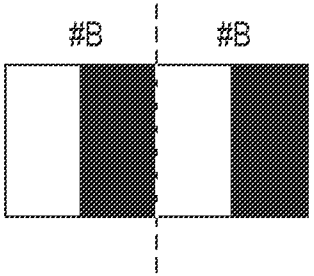
Figure 11E:
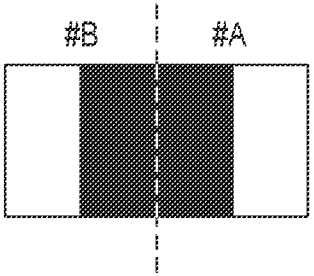
Figure 11F:
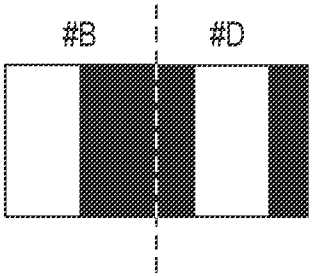
Figure 11G:
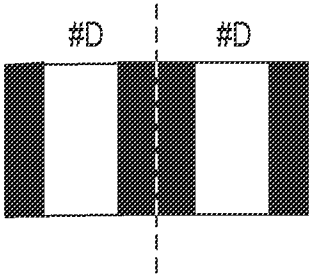
Figure 11H:
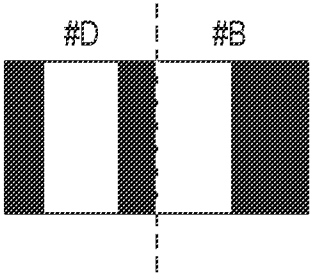
Figure 11I:
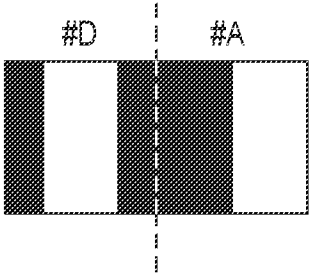

FIGS. 11A to 11I each illustrate a possible combination of exposure patterns that may be applied to two pixels being consecutively present in the main scanning direction and subjected to an exposure amount of 50%, in a case where the pattern information indicates the patterns #A, #B and #D. As illustrated in FIG. 11A, when the pattern #B is applied after the pattern #A, non-exposure regions are consecutively present. Note that as illustrated in FIGS. 11B to 11I, non-exposure regions are not consecutively present in other combinations. In the present embodiment, in a case where pixels having the same pixel value are consecutively present, a CPU 10 randomly selects an exposure pattern to be applied to a pixel from the three exposure patterns, and subsequently the CPU 10 determines whether or not a non-exposure region of the selected exposure pattern and a non-exposure region of an exposure pattern of an immediately preceding pixel are consecutively present. Note that the immediately preceding pixel refers to a pixel exposed to light immediately before in the main scanning direction. In a case where the non-exposure regions are consecutively present, the CPU 10 performs re-selection of an exposure pattern of the pixel.

Figure 12:
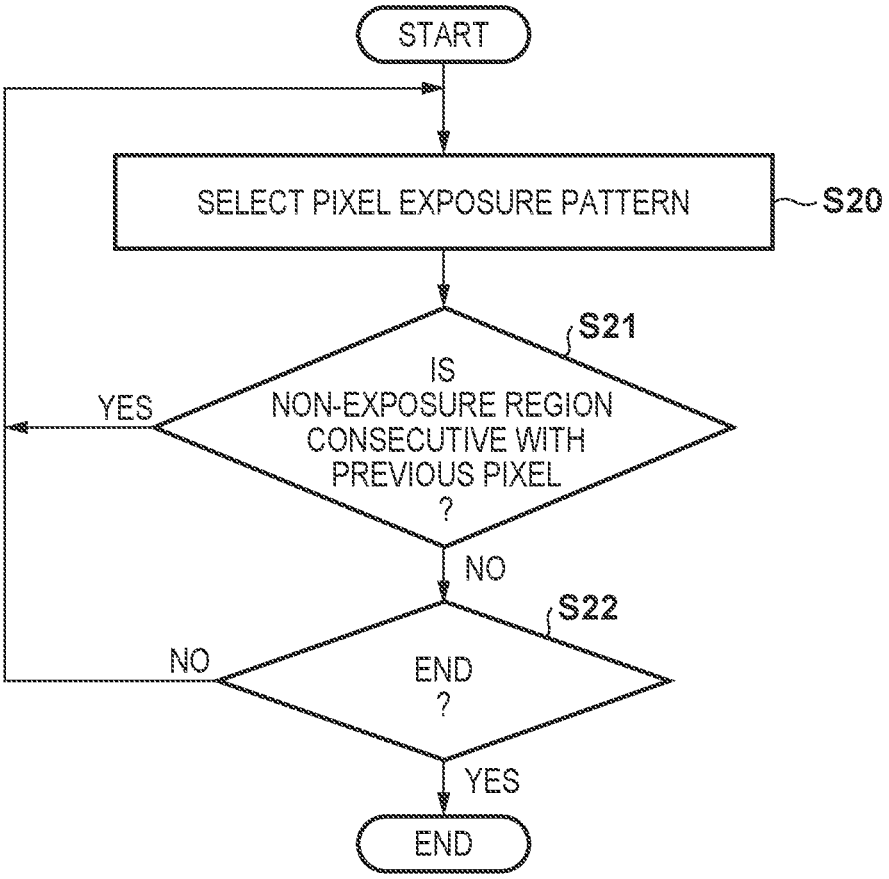
FIG. 12 is a flowchart of drive signal generation processing according to an embodiment.

A flowchart of image forming processing according to the present embodiment is similar to that of FIG. 10 except that, in the generation processing of the drive signal 71 at S13, in a case where pixels having the same pixel value are consecutively present in the main scanning direction, the CPU 10 performs processing for preventing non-exposure regions from being consecutively present between the pixels. FIG. 12 is a flowchart of processing performed by the CPU 10 in a case where pixels having the same pixel value are consecutively present, in the generation processing of the drive signal 71 at S13 of FIG. 10. At S20, the CPU 10 randomly selects an exposure pattern of a determination target pixel from the patterns #A, #B and #D. Note that an initial determination target pixel is a second pixel in a case where pixels having the same value are consecutively present. At S21, the CPU 10 determines whether or not a non-exposure region of the exposure pattern of the determination target pixel selected at S20 and a non-exposure region of an immediately preceding pixel having the same pixel value are consecutively present. In a case where the non-exposure regions are consecutively present, the CPU 10 repeats the processing from S20 until the non-exposure regions are not consecutively present. In a case where the non-exposure region of the determination target pixel and the non-exposure region of the immediately preceding pixel are not consecutively present, the CPU 10 determines at S22 whether or not the processing for the last pixel of the pixels consecutively present has ended. In a case where the processing for the last pixel has not ended, the CPU 10 changes the determination target pixel to a pixel next to be exposed to light, and repeats the processing from S20 until the processing for the last pixel ends. Note that the processing of FIG. 12 is executed each time a portion in which pixels having the same pixel value are consecutively present is generated.

Figure 9E:
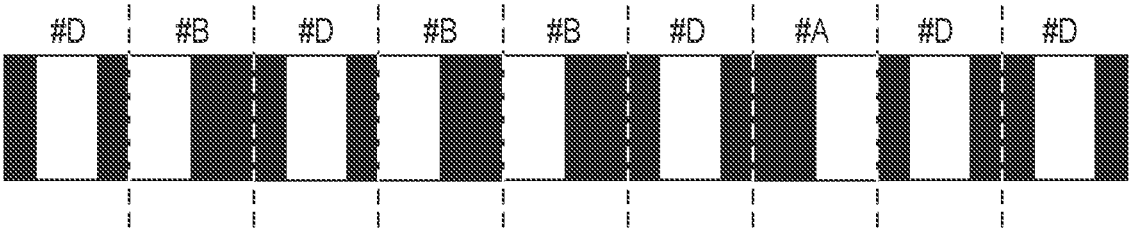

FIG. 9E illustrates an example of the drive signal 71 determined by the processing of FIG. 12 in a case where the pattern information indicates the three exposure patterns of the patterns #A, #B and #D. Note that FIG. 9E is an example of the drive signal 71 for a portion in which the nine pixels each having a pixel value of "128" of FIG. 8B are consecutively present. Even when the pattern #B is selected after the pattern #A (FIG. 11A), re-selection is performed (S21 of FIG. 12), and thus, non-exposure regions are not consecutively present across a boundary between the exposure patterns.

As described above, in the present embodiment, when a plurality of exposure patterns indicated by the pattern information are consecutively used in the main scanning direction, non-exposure regions may be present consecutively across a boundary between the exposure patterns. Thus, in a case where exposure patterns of an identical pixel are consecutively used in the main scanning direction, the CPU 10 randomly selects an exposure pattern under a condition that non-exposure regions are not consecutively present across a boundary between two exposure patterns. For example, in a case where pixels having an identical pixel value are consecutively present in the main scanning direction, the CPU 10 randomly selects an exposure pattern for a second pixel and subsequent pixels, and subsequently determines whether or not a non-exposure region of the selected exposure pattern and a non-exposure region of an immediately preceding pixel are consecutively present. Then, in a case where the non-exposure regions are consecutively present, the CPU 10 repeats the random selection of an exposure pattern of the pixel until the non-exposure regions are not consecutively present. According to the configuration, image quality can be maintained and unnecessary radiation noise can be suppressed as with the first embodiment, while suppressing influence of sweeping and edge effect.

Note that in the present embodiment, there can also be a configuration in which in a case where exposure patterns of an identical pixel are consecutively used in the main scanning direction, selection order (predetermined order) of the exposure patterns is determined in advance, and an exposure pattern to be used is selected in the selection order. The selection order is determined such that lengths in the main scanning direction of non-exposure regions do not vary, that is, non-exposure regions are not consecutively present across a boundary between the exposure patterns. Further, the selection order is determined to suppress unnecessary radiation noise.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-018517, filed Feb. 8, 2021, which is hereby incorporated by reference herein in its entirety.

What is claimed is:

1. An image forming apparatus comprising:

a photoconductor;

an exposure unit configured to form an electrostatic latent image on the photoconductor by scanning the photoconductor with light in a main scanning direction and exposing the photoconductor to the light;

a developing unit configured to develop the electrostatic latent image with developer and form an image on the photoconductor;

a storage unit configured to store pattern information indicating an exposure pattern that is a pattern including an exposure region and a non-exposure region of a pixel along the main scanning direction; and a generation unit configured to generate a drive signal for driving the exposure unit, based on first image data and by using the exposure pattern indicated by the pattern information, wherein the pattern information indicates a plurality of exposure patterns for a first pixel, the plurality of exposure patterns of the first pixel are selected such that whether exposure patterns that are identical to each other among the plurality of exposure patterns of the first pixel are adjacent to each other in the main scanning direction, or two exposure patterns that are different from each other among the plurality of exposure patterns of the first pixel are adjacent to each other in the main scanning direction, the non-exposure regions are not consecutively present across a boundary between the two exposure patterns adjacent to each other, and in a case where the plurality of exposure patterns of the first pixel are consecutively used in the main scanning direction, the generation unit randomly selects an exposure pattern to be used from the plurality of exposure patterns, or selects, in a predetermined order, an exposure pattern to be used from the plurality of exposure patterns.

2. The image forming apparatus according to claim 1, wherein the plurality of exposure patterns of the first pixel include two exposure patterns of a first exposure pattern and a second exposure pattern, the first exposure pattern is an exposure pattern formed by dividing the first pixel along the main scanning direction into three regions, and by setting a first region and a third region as the exposure regions and setting a second region as the non-exposure region, and the second exposure pattern is an exposure pattern formed by dividing the first pixel along the main scanning direction into two regions, and by setting a first region as the exposure region and setting a second region as the non-exposure region.

3. The image forming apparatus according to claim 1, wherein the plurality of exposure patterns of the first pixel include two exposure patterns of a second exposure pattern and a second exposure pattern, the first exposure pattern is an exposure pattern formed by dividing the first pixel along the main scanning direction into three regions, and by setting a first region and a third region as the exposure regions and setting a second region as the non-exposure region, and the second exposure pattern is an exposure pattern formed by dividing the first pixel along the main scanning direction into two regions, and by setting a first region as the non-exposure region and setting a second region as the exposure region.

4. The image forming apparatus according to claim 1, wherein lengths in the main scanning direction of the non-exposure regions of respective exposure patterns of the plurality of exposure patterns of the first pixel are equal to one another.

5. The image forming apparatus according to claim 1, further comprising:

an identification unit configured to identify a correction target pixel among pixels of an image formed from second image data; and a correction unit configured to correct a pixel value of the correction target pixel indicated by the second image data and generate the first image data.

6. The image forming apparatus according to claim 5, wherein the correction target pixel is a pixel determined to generate edge effect or sweeping.

7. The image forming apparatus according to claim 5, wherein the first pixel is a pixel among the correction target pixels that has a pixel value not being a maximum value nor a minimum value of a pixel value.

8. The image forming apparatus according to claim 1, wherein the first pixel is a pixel among pixels indicated by the first image data that has a pixel value not being a maximum value nor a minimum value of a pixel value.

9. An image forming apparatus comprising:

a photoconductor;

an exposure unit configured to form an electrostatic latent image on the photoconductor by scanning the photoconductor with light in a main scanning direction and exposing the photoconductor to the light;

a developing unit configured to develop the electrostatic latent image with developer and form an image on the photoconductor;

a storage unit configured to store pattern information indicating an exposure pattern that is a pattern including an exposure region and a non-exposure region of a pixel along the main scanning direction; and a generation unit configured to generate a drive signal for driving the exposure unit, based on first image data and by using the exposure pattern indicated by the pattern information, wherein the pattern information indicates a plurality of exposure patterns for a first pixel, and in a case where the plurality of exposure patterns of the first pixel are consecutively used in the main scanning direction, the generation unit randomly selects an exposure pattern to be used from the plurality of exposure patterns under a condition that the non-exposure regions are not consecutively present across a boundary between two exposure patterns adjacent to each other in the main scanning direction.

10. The image forming apparatus according to claim 4, wherein the generation unit is further configured to, in a case where the non-exposure region of an exposure pattern randomly selected from the plurality of exposure patterns of the first pixel and the non-exposure region of an exposure pattern determined to be used immediately before in the main scanning direction are consecutively present, repeat randomly selecting an exposure pattern from the plurality of exposure patterns of the first pixel until the non-exposure region of the exposure pattern randomly selected from the plurality of exposure patterns of the first pixel and the non-exposure region of the exposure pattern determined to be used immediately before in the main scanning direction are not consecutively present.

11. The image forming apparatus according to claim 4, wherein the plurality of exposure patterns of the first pixel include three exposure patterns of a first exposure pattern, a second exposure pattern, and a third exposure pattern, the first exposure pattern is an exposure pattern formed by dividing the first pixel along the main scanning direction into three regions, and by setting a first region and a third region as the exposure regions and setting a second region as the non-exposure region, the second exposure pattern is an exposure pattern formed by dividing the first pixel along the main scanning direction into two regions, and by setting a first region as the exposure region and setting a second region as the non-exposure region, and the third exposure pattern is an exposure pattern formed by dividing the first pixel along the main scanning direction into two regions, and by setting a first region as the non-exposure region and setting a second region as the exposure region.

12. An image forming apparatus comprising:

a photoconductor;

an exposure unit configured to form an electrostatic latent image on the photoconductor by scanning the photoconductor with light in a main scanning direction and exposing the photoconductor to the light;

a developing unit configured to develop the electrostatic latent image with developer and form an image on the photoconductor;

a storage unit configured to store pattern information indicating an exposure pattern that is a pattern including an exposure region and a non-exposure region of a pixel along the main scanning direction; and a generation unit configured to generate a drive signal for driving the exposure unit, based on first image data and by using the exposure pattern indicated by the pattern information, wherein the pattern information indicates a plurality of exposure patterns for a first pixel, and in a case where the plurality of exposure patterns of the first pixel are consecutively used in the main scanning direction, the generation unit selects, in a predetermined order, an exposure pattern to be used from the plurality of exposure patterns.

13. The image forming apparatus according to claim 12, wherein the predetermined order is set such that the non-exposure regions are not consecutively present across a boundary between two exposure patterns adjacent to each other in the main scanning direction.

* * * * *